US005836214A

United States Patent [19]

Marquis

[11] Patent Number: 5,836,214

[45] Date of Patent: Nov. 17, 1998

[54] CHOKE PULL-KNOB COVER

[76] Inventor: Kenneth Marquis, 139 Henry St., Shavertown, Pa. 18708

[21] Appl. No.: 743,004

[22] Filed: Nov. 1, 1996

Related U.S. Application Data

[60] Provisional application No. 60/007,563 Mar. 27, 1995.

[51] Int. Cl. [6] ..... G05G 1/02

[52] U.S. Cl. ..... 74/558.5; 74/553; 16/121; 16/114 R

[58] Field of Search ..... 74/553, 558, 558.5; 16/121, DIG. 30, DIG. 41, DIG. 24, 114 R; 292/347, DIG. 2

[56] References Cited

U.S. PATENT DOCUMENTS

| | | | |
|---|---|---|---|
| D. 131,092 | 1/1942 | Tornoe . | |
| D. 192,150 | 1/1962 | Amdur et al. . | |
| D. 211,398 | 6/1968 | Hall . | |
| 1,278,552 | 9/1918 | Allmand | 292/347 X |
| 1,848,892 | 3/1932 | Kollmar | 292/347 X |
| 2,107,204 | 2/1938 | Macksey | 16/121 |
| 2,134,770 | 11/1938 | Weber . | |
| 2,191,304 | 2/1940 | Ashendorf | 74/553 X |
| 2,449,575 | 9/1948 | Wilhelm . | |
| 2,951,358 | 9/1960 | Miller | 74/553 X |
| 2,997,089 | 8/1961 | Amdur et al. | 292/DIG. 2 X |
| 3,306,643 | 2/1967 | Reed . | |
| 3,487,496 | 1/1970 | Guyton et al. | 16/121 |
| 3,742,204 | 6/1973 | Price | 16/DIG. 30 X |
| 4,000,539 | 1/1977 | Neyer . | |
| 4,082,351 | 4/1978 | Chrones . | |
| 4,347,758 | 9/1982 | Geil et al. . | |
| 4,373,405 | 2/1983 | Geil . | |
| 4,397,489 | 8/1983 | Lind | 292/DIG. 2 X |
| 4,608,882 | 9/1986 | Howie, Jr. . | |
| 4,991,461 | 2/1991 | Sennett et al. . | |
| 5,303,612 | 4/1994 | Odom et al. | 74/553 |
| 5,363,720 | 11/1994 | Sanchez | 74/558.5 X |

OTHER PUBLICATIONS

Custom 95 Chrome, 1995, p. 300.

*Primary Examiner*—Charles A. Marmor
*Assistant Examiner*—Mary Ann Battista
*Attorney, Agent, or Firm*—Oblon, Spivak, McClelland, Maier & Neustadt, P.C.

[57] ABSTRACT

A choke cover includes an inflexible housing having a chamber formed therein, an inflexible collar member which is securable to the housing and which has a slot formed therein which radially extends from a longitudinally extending aperture in the collar, and an engaging member engageable with at least one of the collar and the housing so as to secure the collar to the housing and to house the knob within the chamber in the housing. A method of forming the collar includes the steps of positioning the radially slotted inflexible collar on the slide member, positioning the inflexible housing over the knob, and enclosing the knob cover within the chamber formed in the housing and securing the collar to the housing.

11 Claims, 2 Drawing Sheets

CHOKE PULL-KNOB COVER

This application is based on provisional application Ser. No. 60/007,563 filed Nov. 27, 1995.

BACKGROUND OF THE INVENTION

1. Field of the Invention

The present invention is directed to a choke pull-knob cover and a method of securing the cover to a choke knob or any other type of knob positioned on the vehicle, device or other structure.

2. Discussion of the Background

Choke knobs are utilized, for example, on motorcycles. These choke knobs are typically made of plastic or unpolished metal and are thus relatively unattractive. Chrome plated choke knobs are known, such as that which appears in the publication entitled *Custom Chrome* 1995 which is in the form of a choke knob made of aluminum that has been highly polished and chrome plated. Knobs of this type, however, are not choke knob covers but rather choke knob replacements and can only be used when an existing plastic choke knob is of the threaded "screw off and on" style. Most choke knobs of the last decade are molded in position and cannot be unscrewed and therefore require a "cover". There therefore has arisen a clear need for a choke knob cover which can be easily secured to the original choke knob of the motorcycle in a manner which makes the cover easy to secure over the choke knob and which permits the choke cover to be secured in a reliable fashion so as to not become easily dislodged from the motorcycle due to vibrations of the motorcycle when being operated, nor by the pushing and pulling or turning action that a knob cover of this type would be subject to. This choke knob cover should also protect the choke knob from adverse weather conditions and should result in a securing of a choke knob cover which is more aesthetically pleasing than the original choke knob.

SUMMARY OF THE INVENTION

An object of the invention is to provide a choke pull-knob cover for covering a knob of a motorcycle or other type of vehicle, which includes an inflexible housing having a chamber formed therein, a flexible collar member which is securable to the housing and has a slot formed therein which radially extends from a longitudinally extending aperture in the collar, and an engaging member formed on at least one of the collar and the housing for securing the collar to the housing so that the knob is housed in the chamber of the housing.

A further object of the present invention is to provide a method of housing a choke pull-knob cover on a choke knob of a vehicle wherein the choke knob has a slide member secured thereto, which comprises positioning a radially slotted inflexible collar on the slide member, positioning an inflexible housing over the knob, closing the knob within a chamber formed in the housing and securing the collar to the housing.

An additional object of the present invention is to provide a chromed or polished two-part threaded cover which is made of metal or another type of inflexible material that is designed to fit behind and over a plastic choke knob which is found on any of a variety of motorcycles. This knob could also be utilized to cover knobs appearing on an instrument panel of vehicles such as cars, trucks or other mechanisms which have a choke knob, enrichement knob or other type of knob projecting therefrom. The cover could also be utilized in other types of machinery or mechanisms as would be understandable to one of ordinary skill in the art.

A further object of the invention is to provide a cover so that, when installed over an existing plastic choke knob, the cover comprises the device that the motorcyclist can pull to start a cold engine wherein, by moving the choke knob cover, the motorcyclist is able to adjust the air/fuel mixture to start a cold or warm engine.

A yet further object of the present invention is to provide a knob cover which permits the installer to slip a slotted collar onto the choke knob from a side and rear portion of the plastic choke knob such that, while holding the collar in place, one is able to easily install the choke knob cover over the plastic choke knob and screw it to a slotted threaded choke collar housing. Once finger tight, a wrench can then be used from behind the choke collar to tighten it further.

An additional object of the present invention is to provide a method by which the choke knob cover can be easily and reliably secured to the choke knob.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

As illustrated in FIGS. 1–7, the choke pull-knob cover 1 includes a rigid or inflexible cylindrical housing 2 made of metal or other hard material which preferably has a highly polished finish such as a chrome finish. The housing 2 may, however, be of any desirable shape other than cylindrical and can thus be, for example, elliptical or square shaped and cross section.

Figures 1, 6, 7:
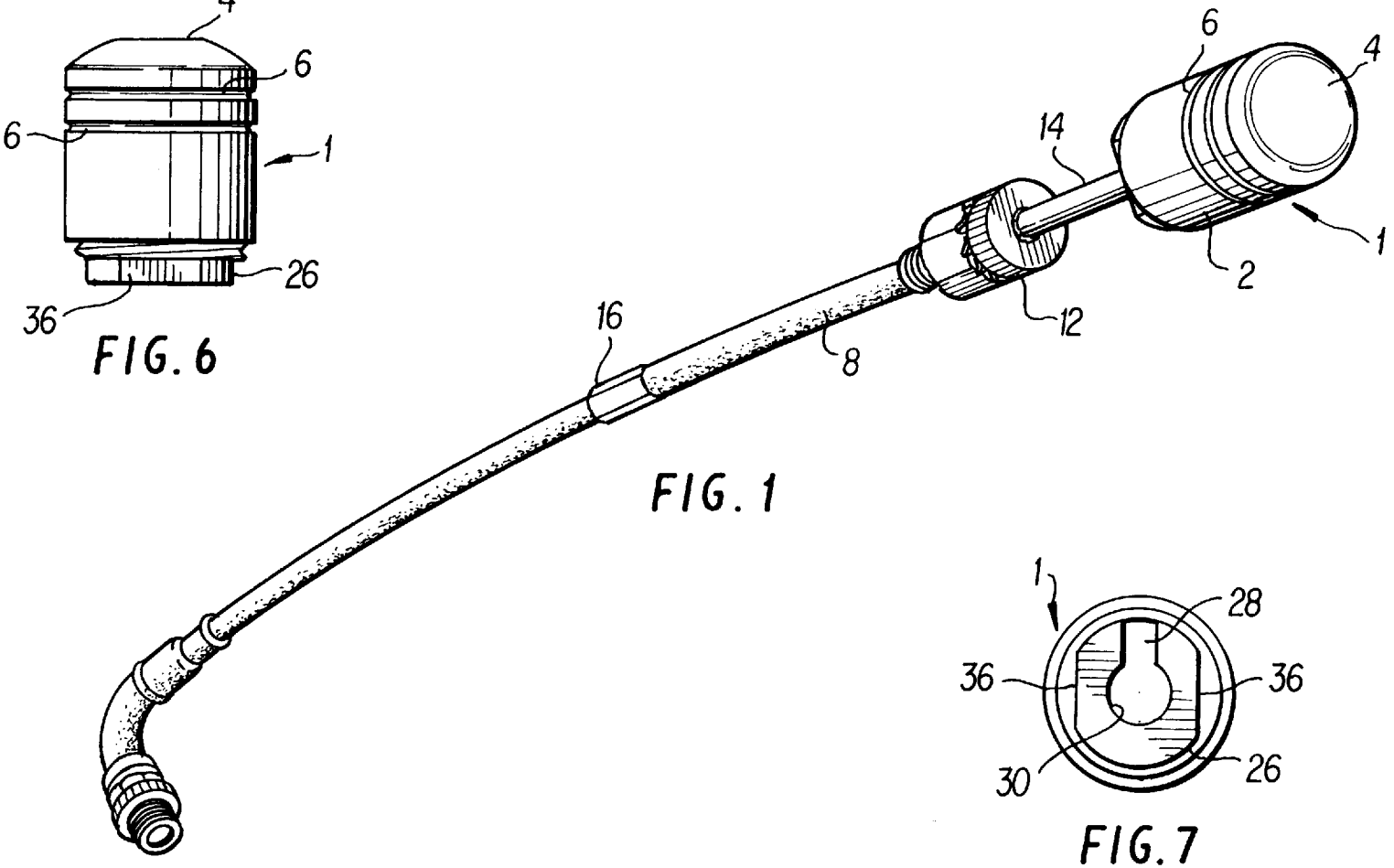
FIG. 1 illustrates the manner in which the knob cover is secured to the choke knob and also illustrates various portions of the structural elements which comprise the choke that is attached to a surface portion of the motorcycle.
FIG. 6 is a left side view thereof, the right side view being a mirror image of the left side view.
FIG. 7 is a bottom plan view thereof.
Figure 2:
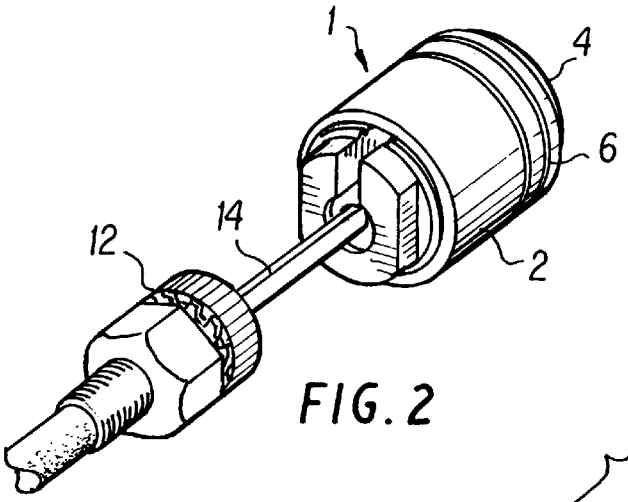
FIG. 2 illustrates a portion of the choke and choke knob cover which more clearly illustrates the structural elements of the knob cover and the manner in which the cover is secured to the choke knob.
Figure 3:
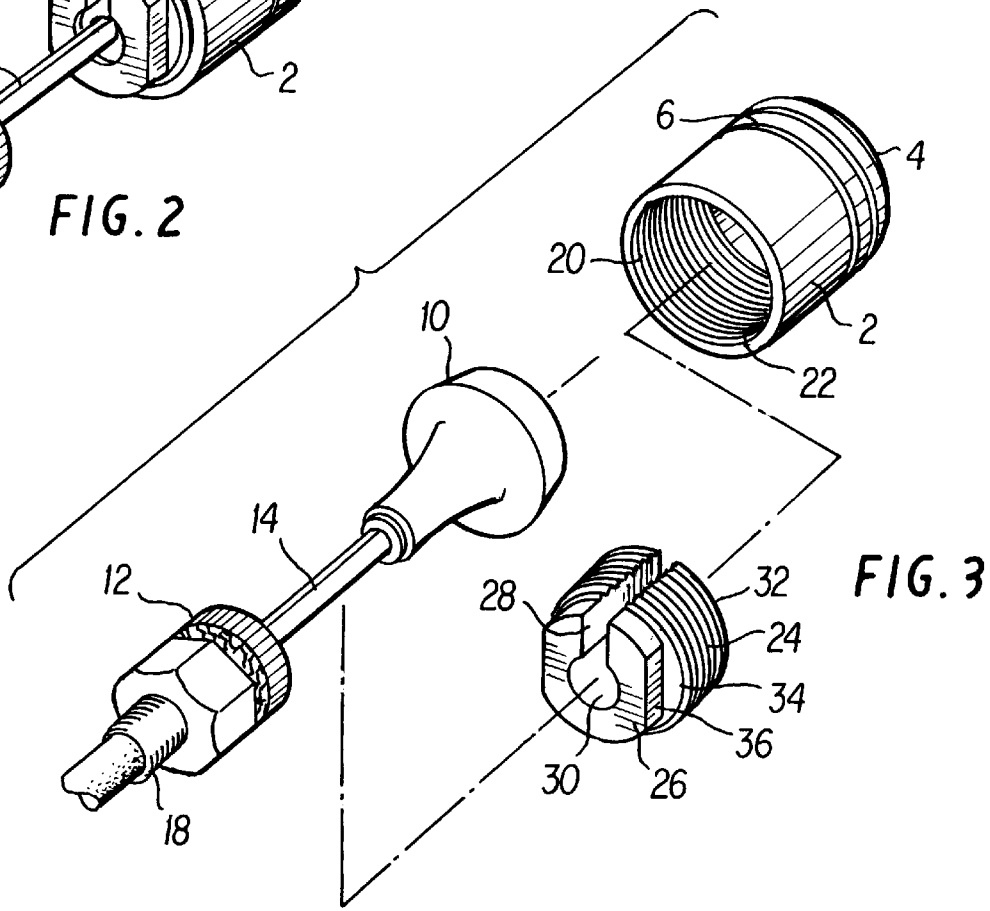
FIG. 3 is an exploded view showing the manner in which the collar is secured behind the choke knob and then threadingly engaged with the choke knob cover housing.
Figure 4:
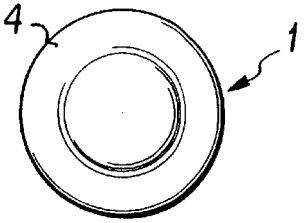
FIG. 4 is a top plan view of the combined choke knob cover and collar.
Figure 5:
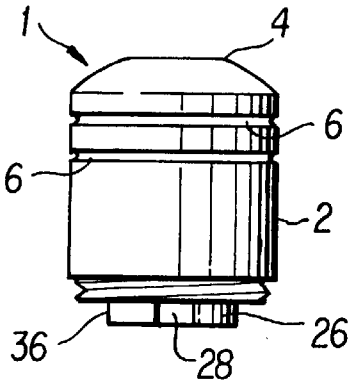
FIG. 5 is a front view thereof, the rear view being a mirror image of the front view.

An end cover 4 is located at one end of the housing 2 and is either integrally formed as a single piece with the housing or is connectable thereto. The housing 2 includes at least one circumferential groove or machined area 6 formed on an outer circumference surface thereof so as to be more easily gripped by an operator. A plastic choke knob 10 is shown in FIG. 3 and is covered by the choke knob cover 2. While a choke knob cover illustrated is for a motorcycle, it is understood that this knob may comprise any other type of knob pulled from a machine and that this knob can be utilized on for example, vehicles such as automobiles, boats, aircraft or any other mechanism having a knob that a manufacturer or operator may wish to have covered to improve the appearance thereof or to make the same more easily gripped by the operator.

A choke knob 10 is illustrated in FIG. 3 and is secured to a guide 12 by which the choke is connectable to a panel of the motorcycle or which could similarly be secured to a dashboard of a vehicle or other surface to which the choke is to be attached.

A slide member or plunger rod 14 is utilized which is slidable in a sleeve 16 and a cover 8 and is further slidable through an aperture provided in guide 12.

As shown in FIG. 3, a plurality of threads 18 are formed on the guide 12 so as to permit threaded engagement with the panel of the motorcycle.

A chamber 20 is formed within housing 2 for positioning of the choke knob 10 and which has a plurality of threads 22 formed therein with which threads 24 of the collar 26 cooperate when screwing the collar 26 into the housing 2.

A radially extending slot 28 is provided in collar 26, the slot extending parallel to the longitudinal axis of the collar. This slot 28 radially extends with respect to the longitudinally extending aperture 30 of the collar to permit passage therethrough of slide member 14. Slot 28 is of a diameter greater than that of slide member 14 to both permit passage of slide member 14 therethrough and to subsequently permit the rotation of collar 26 about slide member 14 when the collar 26 is screwed into the housing 2.

A securing member of a type other than represented by the threads 22 and 26 are possible, such as a releasable snap fitting of collar 24 inside housing 2. Moreover, a screw positioned in an aperture in a side wall of the housing 2 could be utilized wherein an end of the screw would be engageable with the collar.

An end portion 32 of the collar 26 is engageable with an adjacent surface portion of choke knob 10. The dimensions of chamber 20 are such that the knob 10 is positionable within the chamber once the collar has been tightly secured into the housing. This can be done by hand or by first hand tightening same and subsequently using a wrench which grips a flange member 34 with flat sides 36 that extend from one axial end portion of collar 26.

It is advantageous to have both the housing and the collar formed of an inflexible material such as metal so as to reliably secure the collar to the housing by mutual engagement of the threads formed on each of these members and to be able to withstand vibrations from the motorcycle or other vehicle to which the knob is attached as well as to resist adverse weather conditions to which the knob cover may be subjected. This inflexible material therefore permits a tool to be utilized to tightly secure the collar to the housing in a reliable manner.

Obviously, numerous modifications and variations of the present invention are possible in light of the above teachings. It is therefore to be understood that within the scope of the appended claims, the invention may be practiced otherwise than as specifically described herein.

I claimed:

1. A cover assembly which covers a knob which is slidably mounted on a vehicle via a slide member, which comprises:

a substantially inflexible housing having a closed end cover and an open end such that a chamber is formed in said housing, said knob being positioned in said chamber;

a substantially inflexible collar which is securable to the housing and has a radially extending slot formed therein which radially extends from a longitudinally extending aperture in the collar to permit passage therethrough of the slide member of the knob, said collar having a substantially planar end wall portion, a substantial portion of which directly engages with a surface portion of the knob and which extends substantially to a midportion of the housing in a longitudinal direction thereof;

an engaging member engaged with at least one of the collar and the housing for securing the collar to the housing such that the knob is positioned in the chamber of the housing; and at least one groove member formed in an outer circumferential surface of the housing, said groove member assisting an operator in pulling the housing towards the operator for providing choking of a carburetor of the vehicle, said groove member surrounding said outer circumferential surface of the housing.

2. A cover assembly as claimed in claim 1, which comprises a guide member positioned on said slide member and which is engageable with said collar upon movement of the housing toward the vehicle.

3. A cover assembly as claimed in claim 1, wherein an end portion of said collar has a flange member extending therefrom, said flange member assisting in securing of the collar in said chamber of said housing.

4. A cover assembly as claimed in claim 1, wherein said engaging member comprises a screw thread formed on each of said housing and said collar wherein the screw threads of the housing and the collar are engageable with one another.

5. A cover assembly as claimed in claim 4, wherein an end portion of said collar has a flange member extending therefrom, said flange member assisting in securing of the collar in said chamber of said housing.

6. A cover assembly as claimed in claim 4, wherein said at least one groove member assists an operator in one of choking and enrichment of the carburetor or an engine of the vehicle.

7. A cover assembly as claimed in claim 1, wherein said knob comprises one of a choke knob and an enrichment knob of the vehicle.

8. A cover assembly as claimed in claim 7, wherein the vehicle comprises a motorcycle and wherein the knob has the slide member secured thereto.

9. A method of housing a knob of a vehicle wherein said knob is mountable on a slide member, which comprises:

forming a substantially inflexible housing with a closed end cover and with at least one groove member in an outer circumferential surface of said housing, said groove member surrounding said outer circumferential surface of said housing;

forming a substantially planar end wall and a radially extending slot in a substantially inflexible collar;

positioning said collar on the slide member by passing the slide member through said slot formed in said collar;

positioning said housing over the knob;

enclosing the knob within a chamber formed in the housing and directly contacting a substantial portion of said planar end wall portion of said collar with a surface portion of the knob such that the end wall of the collar extends to substantially a midportion of said housing in a longitudinal direction thereof; and securing the collar to the housing.

10. A method as claimed in claim 9, wherein the securing of the collar to the housing comprises providing threads on the collar and the housing and mutually engaging the threads of the collar with the threads on the housing.

11. A method of housing a knob as claimed in claim 9, which comprises positioning a guide member on said slide member so as to be engageable with said collar upon movement of the housing toward the vehicle.

* * * * *